United States Patent [19]

Walker et al.

[11] 4,126,002

[45] Nov. 21, 1978

[54] MINE ROOF SUPPORT

[75] Inventors: John H. Walker; James A. Sutton, both of Cheltenham, England

[73] Assignee: Dowty Mining Equipment Limited, England

[21] Appl. No.: 765,856

[22] Filed: Feb. 4, 1977

[30] Foreign Application Priority Data

Feb. 6, 1976 [GB] United Kingdom ..... 4687/76

[51] Int. Cl.[2] ..... E21D 15/44

[52] U.S. Cl. ..... 405/296

[58] Field of Search ..... 61/45 D; 299/31, 33

[56] References Cited

U.S. PATENT DOCUMENTS

| | | | |
|---|---|---|---|
| 3,800,546 | 4/1974 | Holken et al. | 61/45 D |
| 3,903,703 | 9/1975 | Lubojatsky | 61/45 D |
| 4,020,640 | 5/1977 | Sigott et al. | 61/45 D |

FOREIGN PATENT DOCUMENTS

| | | | |
|---|---|---|---|
| 1,937,308 | 2/1971 | Fed. Rep. of Germany | 61/45 D |
| 2,502,109 | 7/1975 | Fed. Rep. of Germany | 61/45 D |

*Primary Examiner*—Jacob Shapiro

*Attorney, Agent, or Firm*—Young & Thompson

[57] ABSTRACT

A mine roof support comprising a floor-engaging member, one or more shielding members above the floor-engaging member, a flap pivotally mounted on the or on a shielding member and a sealing member pivotally mounted on the flap.

8 Claims, 7 Drawing Figures

MINE ROOF SUPPORT

This invention relates to a mine roof support.

In accordance with the present invention a mine roof support comprises a floor-engaging member, one or more shielding members above the floor engaging member, a flap pivotally-mounted on the or on a shielding member, and a sealing member pivotally-mounted on the flap. The axes about which the flap and the sealing member are pivotally-mounted may be parallel to each other and may also be parallel to an edge of the shielding member.

When the mine roof support is adjacent another mine roof support, the sealing member may be urged outwardly by suitable means, into engagement with the corresponding shielding member of the adjacent support so as at least substantially to close the gap between the two corresponding shielding members when the supports are aligned the one parallel to the other.

The sealing member may be flat and parallel to the axis about which it is pivotally mounted.

The shielding member carrying the flap and the sealing member may be a roof-engaging canopy.

The roof-engaging canopy may be pivotally connected to another shielding member which in turn is pivotally mounted on the floor-engaging member. Such other shielding member is referred to for convenience as a shield. The shield may have a side shield which is slidable beyond one edge of the shield such that it is capable of engaging the edge of a shield of a similar adjacent support and at least substantially closing the gap therebetween.

The side shield may engage the sealing member of the canopy so that common power-operated means may urge both the side shield and the sealing member outwardly.

The shield may be mounted on the floor-engaging member by means of a pair of links extending from two pivotal connections on the floor-engaging member to two pivotal connections on the shield such that the upper end of the shield remote from the pivotal connections is constrained by the links during angular shield movement to move in an approximately straight line perpendicular to the plane of the floor-engaging member.

One embodiment of the invention will now be described with reference to the accompanying drawings in which.

Figure 1:
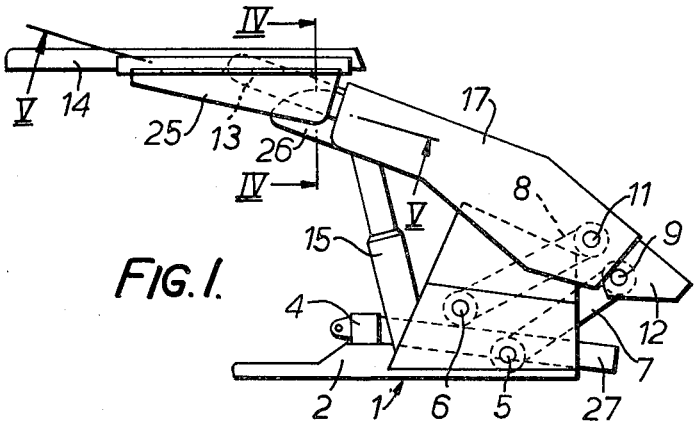
FIGS. 1 and 2 are side and front elevations of the support.
Figure 2:
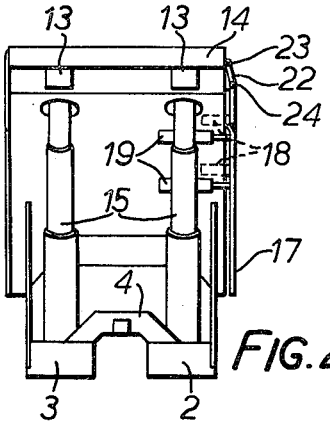
Figure 3:
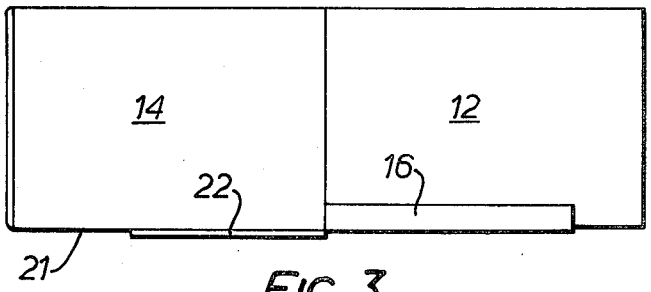
FIG. 3 is a plan of the support.

Reference is made initially to FIGS. 1, 2 and 3. The floor beam 1 in this particular embodiment comprises a pair of box section parallel members 2 and 3 secured together in spaced relation by a number of bridge members of which one bridge member 4 is shown in FIG. 2. At the rear end portion of the floor beam 1 there are a pair of pivotal mountings 5 and 6 whose axes are parallel and transverse to the length of the floor beam. A pair of links 7 and 8 extend upwardly from the pivotal connections 5 and 6 to a pair of pivotal connections 9 and 11 located on the lower end portion of a shield 12. The shield 12 extends forwardly and upwardly above the floor beam and terminates in a pair of lugs 13 whose ends pivotally mount a roof engaging canopy 14, the pivot axis lying transverse to the length of the floor beam 1. A pair of hydraulically extendible props 15 extend between the floor beam and the shield in mutually-parallel relation, being mounted both on the floor beam and the shield by pivotal joints. Extension or contraction of the props 15 will cause the shield 12 to move angularly and to vary its inclination relative to the floor beam. During such movement the action of the links 7 and 8 is such as to ensure that the free ends of the lugs 13 move in an approximately straight line perpendicular to the plane of the floor beam 1.

Figure 4:
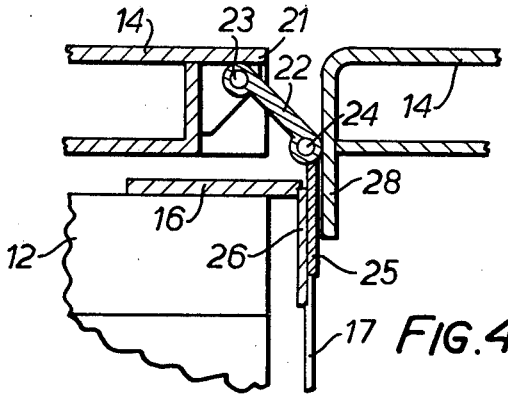
FIG. 4 is an enlarged cross-section of a detail taken on the line IV—IV in FIG. 1.

The shield 12 (see FIG. 4) carries a side shield 16 slidable on its upper surface and the outer edge of the side shield 16 carries a vertically extending flange 17. The side shield 16 and flange 17 are mounted in position for sliding movement by means of a pair of pins 18 which extend from the flange 17 into appropriate sockets in the side of the shield. Two hydraulic jacks 19 (see FIG. 2) mounted on the underside of the shield 12 extend to the flange 17 for urging the side shield and flange outwardly.

Along one edge 21 of canopy 14 (see FIG. 4) at the same side as side shield 16, a flap 22 is secured in position by means of a hinge 23, the axis of the hinge being parallel to the edge 21. At the position spaced from hinge 23 the flap 22 itself carries a further hinge 24 whose axis is parallel to the axis of hinge 23. The hinge 24 supports a flat sealing member 25 which extends downwardly from the hinge 24.

Figure 5:
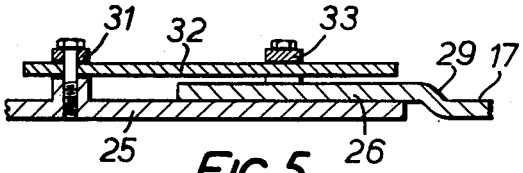
FIG. 5 is an enlarged cross-section of a further detail taken on the line V—V of FIG. 1.
Figure 6:
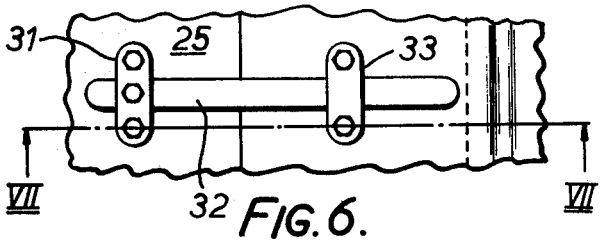
FIG. 6 is a scrap view showing the detail of FIG. 5 in elevation and, FIG. 7 is a cross-section taken on the line VII—VII of FIG. 6.
Figure 7:
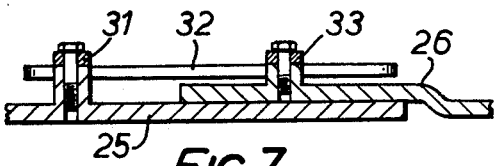

Reference is now made to FIGS. 5, 6 and 7 of the drawings. In order that the sealing member 25 and flap 22 may be urged outwardly there is an extension 26 at the upper end of flange 17 which is arranged to engage underneath the sealing member 25, whereby outward movement of side shield 16 and flange 17 will also cause outward movement of sealing member 25. The step 29 in between the flange 17 and its extension 26 enables the outer surfaces of the sealing member 25 and the flange 17 to lie substantially in the same plane. To facilitate retraction of the sealing member 25 the inside surface thereof at a position beyond the extension 26 is provided with a bracket 31 which pivotally supports a bar 32 extending over the inner surface of extension 26. The inner surface of extension 26 includes a bracket 33 provided with a slot through which the bar 32 is slidable, there being a clearance between slot and bar such that the bar may move angularly relative to the extension 26 in a plane parallel to its inner surface. When the side shield 16 and flange 17 are urged outwardly by the jacks 19 the sealing member 25 is also urged outwardly by direct contact with extension 26. Outward movement of the member 25 will, of course, involve angular movement of the flap 22 which supports it. When the side shield 16 and flange 17 are retracted, extension 26 would tend to move away from sealing member 25 if it were not for the mechanism shown in FIGS. 5, 6 and 7. Withdrawing movement of the extension 26 will, by virtue of bracket 33, move the bar 32 inwardly towards the underside of the shield and canopy. Such movement of the bar 32 will, by virtue of its engagement in bracket 31 also carry sealing member 25 inwardly. During such movement the sealing member 25 will move downwardly relative to extension 26 but such movement will be accommodated by the pivotal mounting of bar 32 and bracket 31 and the ability of bar 32 to slide and pivot within the bracket 33. The canopy may move angularly relative to the shield in any manner as permitted by the pivotal mounting of the canopy on the lugs 13, and such angular movement is accommodated at the connection between extension 26 and member 25 by relative angular movement between bar 32 and its brackets 31 and 33 and sliding movement of bar 32 in bracket 33. The shield may be constructed in two parts as disclosed in our co-pending application Ser. No. 675804 to enable the canopy to tilt about a longitudinal axis when engaging the roof. Such tilting will not affect the sealing engagement between a sealing member 25 and an adjacent canopy flange 28 since it is accommodated by the hinges 23 and 24.

When the described roof support is in use it is arranged in a row with a number of similar supports along the mineral face in a mine, all supports being extended so that their canopies engage the roof. Each support is provided with an advancing jack 27 located in the gap between the two portions 2 and 3 of the floor beam, such advancing jack being connected to a suitable abutment whereby each roof support when released from the roof may advance itself towards the abutment, the abutment normally being in the front of the support under the protection of the forward end of the canopy 14. When the row of supports is set against the roof the side shield 16 of each support is pushed outwardly by means of the jack 19 so that the flange 17 engages against the flat side of the shield 12 of the adjacent support, sealing the gap between the shields to prevent entry of debris and dust from the roof. The outward movement of the flange 17 carries with it the extension 26 which will engage under sealing member 25 and urge it outwardly into contact with the flat side 28 of the canopy of the adjacent roof support, again forming a seal against entry of debris and dust from the roof in between the canopies into the protected working space under the canopies. The sealing member 25 will rise slightly during outward movement due to the fact that it is supported by the flap 22 which is connected by hinge 23 to the canopy. The mounting of the side shields 16 by means of the two sliding pins 18 is such that the side shield has the ability for slight angular movement in order to accommodate itself to the edge of the shield of an adjacent support which might not be in exactly parallel relation. It will be seen that under these circumstances the extension 26 of flange 17 will transmit the appropriate movement to sealing member 25 to cause it to move outwardly into contact with the adjacent side 28 of a canopy on the adjacent support. In order that the side faces of the flange 17 and of the sealing member 25 should present an approximately flat surface the extension 26 is set inwardly from flange 17 as shown in FIGS. 5 and 7 at 29. This arrangement will enable relative movement to take place between supports when one support advances towards the abutment and will reduce the possibility that one support, when moving, may catch against the end of the sealing member 25 adjoining flange 17.

Whilst the embodiment described with reference to the drawings has a flap pivotally-mounted to the canopy of a roof support it will be appreciated within the broad scope of the invention that the flap may be mounted on other shielding members of a roof support such, for example, as on the side of the shield itself, in order to engage an adjacent shielding member to seal the gap between them.

Further, it will be appreciated that the invention is applicable to any kind of roof support having a shielding member irrespectively of the number of extendible legs or other means used to maintain the shielding member in position above the floor-engaging member. Within the broad scope of the invention any means other than legs may be used to hold the shielding member in position. Also it will be appreciated that any shielding member may within the scope of the invention have two or more flaps and sealing members mounted thereon. For example, in the drawings the canopy 14 may have two flaps mounted by hinges one on each of its two parallel edges, e.g. 21, each such flap having a sealing member pivotally mounted thereon. Each such sealing member may be urged outwardly by means of a power urged flange, e.g. 17, carried by an adjacent shielding member such as shield 12.

We claim:

1. A mine roof support comprising a floor-engaging member, a roof-engaging canopy adjustable in height above the floor-engaging member, a shield pivotally mounted on the floor-engaging member and pivotally supporting the canopy, a flap pivotally mounted on the canopy, a sealing member pivotally mounted on the flap, a side shield slidable beyond one edge of the shield and engaging the sealing member, and a common power operated means to urge both the side shield and the sealing member outwardly.

2. A mine roof support as claimed in claim 1 wherein the power operated means is double acting to urge both the side shield and the sealing member inwardly and outwardly.

3. A mine roof support comprising a floor-engaging member, a roof-engaging canopy adjustable in height above the floor-engaging member, a shield pivotally mounted on the floor-engaging member and pivotally supporting the canopy, a flap pivotally mounted on the canopy, a sealing member pivotally mounted on the flap, a side shield slidable beyond one edge of the shield and a bar pivotally connected to one of the side shield and sealing member and slidable and pivotally connected to the other.

4. A mine roof support as claimed in claim 3, wherein the outer surfaces of the sealing member and side shield are substantially co-planar, the bar being located on the inner surfaces of the sealing member and the side shield.

5. A mine roof support as claimed in claim 1, wherein the engagement between the side shield and the sealing member comprises a pivotal and sliding connection.

6. A mine roof support comprising a floor-engaging member, a roof-engaging canopy adjustable in height above the floor-engaging member, a shield pivotally mounted on the floor-engaging member and on the canopy, a flap pivotally mounted on the canopy and a sealing member pivotally mounted on the flap.

7. A mine roof support as claimed in claim 6, wherein the pivotal mounting of the shield on the floor-engaging member comprises a pair of spaced links pivotally connected to the shield about two parallel axes and pivotally connected to the floor-engaging member about two parallel axes, whereby to constrain the part of the shield pivotally connected to the canopy for movement along a fixed path relative to the floor-engaging member.

8. A mine roof support, comprising a floor-engaging member, a roof-engaging canopy, two flaps secured to the canopy, one at each of two outer parallel edges, a sealing member pivotally secured to each flap, a shield pivotally mounted on the floor-engaging member and pivotally supporting the canopy, two side shields slidably mounted one on each of the two outer edges of the shield, engagement means securing each side shield to its adjacent sealing member and a power operated means for each side shield to urge it and the adjacent sealing member outwardly.

* * * * *